US011454916B2

(12) United States Patent
Wakai et al.

(10) Patent No.: US 11,454,916 B2
(45) Date of Patent: Sep. 27, 2022

(54) LUBRICANT APPLICATION DEVICE FOR NON-CONTACT APPLYING OF LUBRICANT

(71) Applicant: Hewlett-Packard Development Company, L.P., Spring, TX (US)

(72) Inventors: Takayuki Wakai, Yokohama (JP); Takeshi Uchitani, Yokohama (JP); Katsushi Higashida, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/299,096

(22) PCT Filed: Aug. 26, 2020

(86) PCT No.: PCT/US2020/047979
§ 371 (c)(1),
(2) Date: Jun. 2, 2021

(87) PCT Pub. No.: WO2021/050273
PCT Pub. Date: Mar. 18, 2021

(65) Prior Publication Data

US 2022/0197208 A1 Jun. 23, 2022

(30) Foreign Application Priority Data

Sep. 10, 2019 (JP) ..... JP2019-164114

(51) Int. Cl.
*G03G 21/00* (2006.01)

(52) U.S. Cl.
CPC ..... *G03G 21/0094* (2013.01); *G03G 21/0011* (2013.01)

(58) Field of Classification Search
CPC ..... G03G 21/0094
USPC ..... 399/346
See application file for complete search history.

(56) References Cited

U.S. PATENT DOCUMENTS

| | | | | |
|---|---|---|---|---|
| 7,693,475 | B2 | 4/2010 | Shakuto et al. | |
| 9,507,312 | B2 * | 11/2016 | Nishisaka | G03G 21/0094 |
| 9,989,885 | B2 | 6/2018 | Saito et al. | |
| 10,466,642 | B2 * | 11/2019 | Amemiya et al. | G03G 21/0094 |
| 2007/0183824 | A1 | 8/2007 | Suda et al. | |
| 2007/0258743 | A1 | 11/2007 | Shakuto et al. | |
| 2012/0141178 | A1 * | 6/2012 | Minegishi et al. | G03G 21/0094 399/346 |
| 2017/0160696 | A1 * | 6/2017 | Ogura et al. | G03G 21/0094 |

FOREIGN PATENT DOCUMENTS

| | | |
|---|---|---|
| JP | 2007079247 A | 3/2007 |
| JP | 2007333788 | 12/2007 |
| JP | 2009271159 A | 11/2009 |
| JP | 2012181317 | 9/2012 |
| JP | 2013130770 | 7/2013 |

* cited by examiner

*Primary Examiner* — William J Royer
(74) *Attorney, Agent, or Firm* — Jefferson IP Law, LLP

(57) ABSTRACT

A lubricant application device for an image forming apparatus includes a grinding roller that is rotatable to scrape off a lubricant from a solid lubricant source, and a scattering member to scatter the lubricant from the grinding roller toward a separate rotating member.

15 Claims, 16 Drawing Sheets

LUBRICANT APPLICATION DEVICE FOR NON-CONTACT APPLYING OF LUBRICANT

BACKGROUND

An image forming apparatus that uses an electrophotography technique may operate to: adhere toner to an image carrier having a latent image formed thereon, transfer the toner to paper, and fix the transferred toner onto the paper. The image carrier is also called a photosensitive drum. To extend a service life of the image carrier, a lubricant can be applied to a surface of the image carrier.

DETAILED DESCRIPTION

Figure 1:
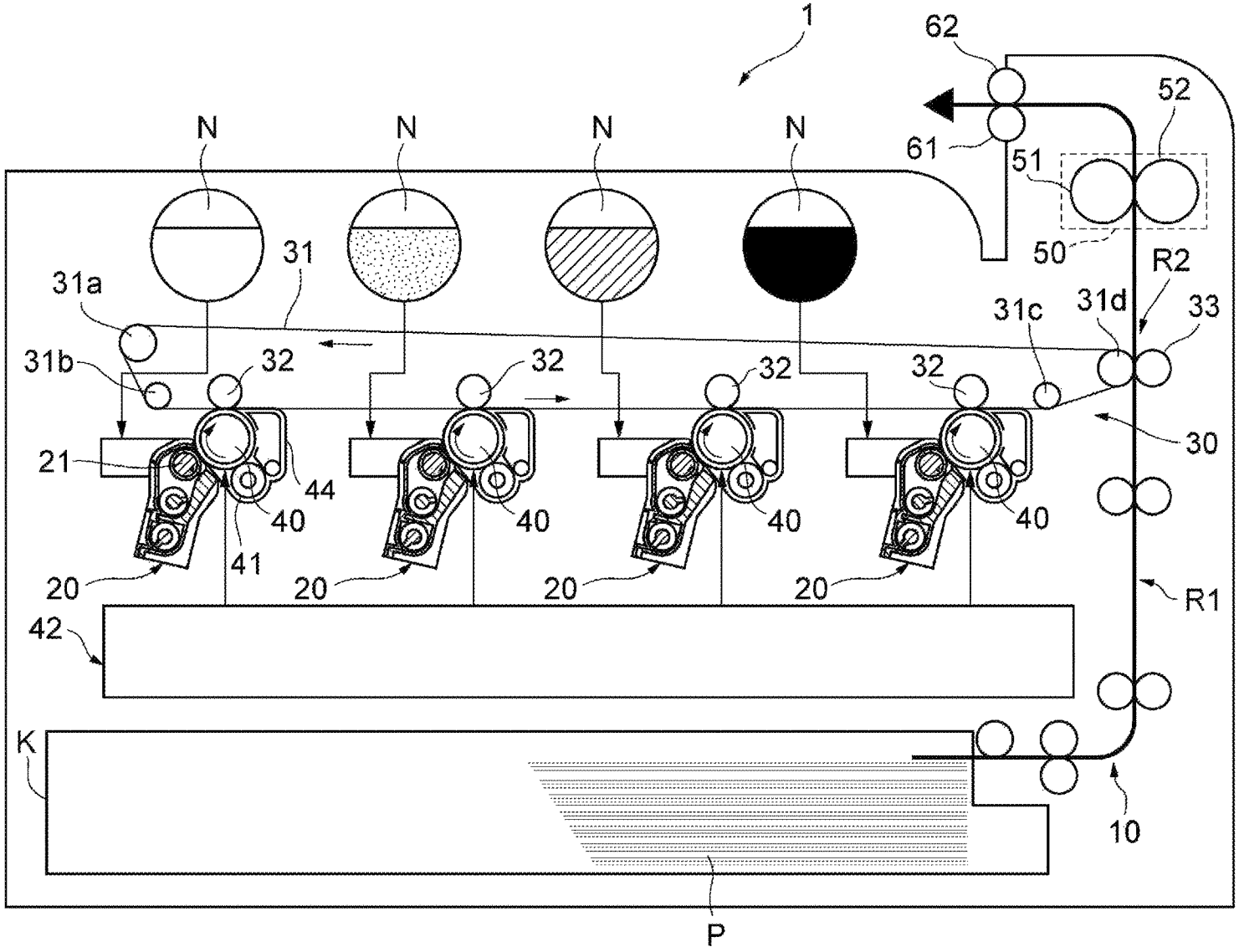
FIG. 1 is a view showing a schematic diagram of an example image forming apparatus.

In the following description, with reference to the drawings, the same reference numbers are assigned to the same components or to similar components having the same function, and overlapping description is omitted. The drawings may not illustrate all feature elements to scale, and some features or components may be partially emphasized in some drawings for ease of description of the operations and effects of the present disclosure.

An example lubricant application device for an image forming apparatus may include a grinding roller to carry, upon rotation, a lubricant scraped off from a solid lubricant source, and a scattering member disposed to contact the grinding roller at an outer periphery thereof, to scatter the carried lubricant toward a separate rotating member. For example, the scattering member may cause the carried lubricant to be scattered and to direct at least a portion of the scattered lubricant toward the rotating member. Fine particles of a scraped-off lubricant is pulverized and scattered to a rotating member to apply the lubricant in a more uniform manner.

In some examples, the rotating member includes an image carrier, and the scattering member includes a rod-shaped member (or rod member). The scattering member may include a plurality of rod-shaped members. Each of the rod-shaped members may be a round rod (e.g., having a round cross-section) or a rectangular column (e.g., having a rectangular cross-section). The rod-shaped member extends longitudinally and has a central axis in the longitudinal direction, and the rod-shaped member is rotatable about the central axis. Accordingly, the scattering of the lubricant may be achieved with a simple configuration, while further preventing or inhibiting the lubricant from being fixed or deposited on the rod-shaped member.

According to some examples, the scattering member includes a plurality of wires, to achieve the scattering of lubricant with a relatively simple configuration. In addition, a vibration of the wire can prevent a lubricant from being fixed or deposited on the wire, to improve the effect of pulverizing the fine particles of the lubricant and the efficiency of scattering the fine particles.

According to some examples, the scattering member includes a perforated member, to more efficiently scatter the lubricant toward the rotating member. In some examples, the perforated member may include a flat plate, or in other examples, the perforated member may be curved so as to follow the outer periphery of the grinding roller. In addition, the perforated member may include one or more openings or holes having a rectangular shape for example.

According to some examples, the lubricant application device includes a blade disposed, downstream of the grinding roller in a direction in which a surface of the rotating member moves, to abut the surface of the rotating member such that the lubricant scattered toward the rotating member is smoothly applied over the surface of the rotating member by the blade, such that the lubricant scattered toward the rotating member is expanded (or spread) and more smoothly applied over the surface of the rotating member.

According to some examples, the grinding roller is rotatable both clockwise and counterclockwise to protect the bristles of the grinding roller, and eliminate or reduce a bristle falling of the grinding roller.

According to some examples, the grinding roller and the scattering member are conductive, and the lubricant application device includes a voltage source to apply different voltages to the grinding roller and the scattering member, in order to more efficiently apply the lubricant to the rotating member.

An example lubricant application device for an image forming apparatus may include: a brush roller having radially extending bristles to carry, upon rotation, a lubricant scraped off from a solid lubricant source; and a rod-shaped member disposed to engage and bend the bristles as the brush roller rotates. The rod-shaped member avoids contact with a rotating member, while causing the carried lubricant to be scattered toward the rotating member when the bristles are disengaged from the rod-shaped member. Fine particles of a scraped-off lubricant is pulverized and scattered to a rotating member, to apply the lubricant in a more uniform manner.

An example image forming apparatus may include the above-described lubricant application device.

With reference to FIG. 1, a schematic configuration of an example image forming apparatus 1 will be described. The image forming apparatus 1 may form a color image by use of the colors of magenta, yellow, cyan and black. The image forming apparatus 1 can have a recording medium conveyance unit 10 for conveying a recording medium such as paper (or paper sheet) P, developing devices 20 for developing an electrostatic latent image, a transfer unit 30 for secondary transfer of a toner image on the paper P, photosensitive drums 40 as an electrostatic latent image carrier having a peripheral surface to form an image thereon, and a fixing unit 50 for fixing the toner image on the paper P.

The recording medium conveyance unit 10 can convey the paper P as a recording medium on which an image is to be formed, along a conveyance path R1. The paper P can be stacked and accommodated in a cassette K. The recording medium conveyance unit 10 can allow the paper P to arrive at a secondary transfer region R2 through the conveyance path R1 at the timing when a toner image to be transferred to the paper P arrives at the secondary transfer region R2.

One developing device 20 is provided for each color, and accordingly, four developing devices 20 can be provided in total. Each developing device 20 can have a developing roller 21 for allowing toner to be carried on a photosensitive drum 40. The developing device 20 adjusts a mixing ratio of toner (e.g., toner particles) and carrier (e.g. carrier particles) to a predetermined or target ratio; and further, mixes and stirs the toner and carrier particles to disperse the toner uniformly, to obtain a developer having an optimal charge amount imparted thereto. The developer, containing the toner and the carrier, is carried on the developing roller 21. A rotation of the developing roller 21 conveys the developer to a region facing the photosensitive drum 40, where the toner of the developer carried on the developing roller 21, is moved (or transferred) onto the electrostatic latent image formed on the circumferential surface of the photosensitive drum 40, in order to develop the electrostatic latent image.

The transfer unit 30 can convey a toner image formed by the developing device 20 to the secondary transfer region R2 where the toner image is to be secondarily transferred to the paper P. The transfer unit 30 can include a transfer belt 31, support rollers 31*a*, 31*b*, 31*c* and 31*d* supporting the transfer belt 31, a primary transfer roller 32 adjacent the photosensitive drum 40 such that the primary transfer roller 32 holds the transfer belt 31 together with the photosensitive drum 40, and a secondary transfer roller 33 located adjacent the support roller 31*d* such that the secondary transfer roller 33 holds the transfer belt 31 together with the support roller 31*d*.

The transfer belt 31 can be an endless belt, which is circularly moved by support rollers 31*a*, 31*b*, 31*c* and 31*d*. The primary transfer roller 32 can be provided so as to press against the photosensitive drum 40 from an inner circumference of the transfer belt 31. The secondary transfer roller 33 can be provided so as to press against the support roller 31*d* from an outer circumference of the transfer belt 31.

One photosensitive drum 40 may be provided for each color, and accordingly, four photosensitive drums 40 can be provided in total. The photosensitive drums 40 can be spaced apart along a moving direction of the transfer belt 31. About the circumference of each of the photosensitive drums 40, a corresponding one of the developing devices 20, a corresponding charging roller 41, a corresponding exposure unit (exposure device) 42, a corresponding cleaning unit 44, and the like can be provided.

The charging roller 41 can include charging means (e.g., a charging device) that uniformly charges the surface of the photosensitive drum 40 at a predetermined electric potential. The charging roller 41 can rotate as it follows the rotation of the photosensitive drum 40. The exposure unit (or device) 42 can irradiate a light to the surface of the photosensitive drum 40, which has been charged by the charging roller 41, in accordance with the image to be formed on the paper P. Exposure to the light changes the electric potential of the exposed portion of the surface of the photosensitive drum 40, to form an electrostatic latent image on the surface of the photosensitive drum 40. The four developing devices 20 develop respective electrostatic latent images on the respective photosensitive drums 40, with toner supplied from respective toner tanks N that face the respective developing devices 20, so that a toner image is generated on each of the photosensitive drums 40. The toner tanks N are filled with magenta, yellow, cyan and black toners, respectively. The cleaning unit 44 collects toner remaining on the photosensitive drum 40 after the toner image formed on the corresponding photosensitive drum 40 is primarily transferred to the transfer belt 31. In some examples, the photosensitive drum 40 and the charging roller 41 are attached to a housing, such that the cleaning unit 44, the photosensitive drum 40 and the charging roller 41 are unitized.

The fixing unit 50 can adhere and fix the toner image to the paper P, which has been secondarily transferred from the transfer belt 31 to the paper P. The fixing unit 50 can have a heating roller 51 for heating the paper P and a pressing roller 52 for pressing the heating roller 51. The heating roller 51 and the pressing roller 52 are formed in a cylindrical shape, and the heating roller 51 can have a heat source such as a halogen lamp therein. A fixing nip portion as a contact region is provided between the heating roller 51 and the pressing roller 52, and the paper P may be conveyed through the fixing nip portion to melt and fix the toner image onto the paper P.

The example image forming apparatus 1 can be provided with discharge rollers 61, 62 for discharging, to the outside of the apparatus 1, the paper P having the toner image fixed thereon by the fixing unit 50.

Example printing operations of the example image forming apparatus 1 will be described. An image signal of an image to be recorded (e.g., to a recording medium), may be input into the image forming apparatus 1. The example image forming apparatus 1 includes a control section such as a controller to control the charging roller 41 to uniformly charge the surface of the photosensitive drum 40 at a predetermined electric potential (charging process). Based on the received image signal, the exposure unit 42 applies laser light to the surface of the photosensitive drum 40 to form an electrostatic latent image (exposure process).

In the example developing device 20, a toner image is formed so that the electrostatic latent image is developed (developing process). The formed toner image is primarily transferred from the photosensitive drum 40 to the transfer belt 31 at a region where the photosensitive drum 40 faces the transfer belt 31 (transfer process). Toner images formed on the four photosensitive drums 40 are sequentially layered on the transfer belt 31, so that a single composite toner image can be formed. The composite toner image can be secondarily transferred to the paper P conveyed from the recording medium conveyance unit 10 at the secondary transfer region R2 where the support roller 31*d* faces the secondary transfer roller 33.

The paper P having the composite toner image secondarily transferred thereon, can be conveyed to the fixing unit 50. The paper P is passed between the heating roller 51 and the pressing roller 52 while heat and pressure are applied to the paper. Accordingly, the composite toner image is melted and fixed onto the paper P (fixing process). Thereafter, the paper P can be discharged by the discharge rollers 61, 62 to the outside of the image forming apparatus 1.

Figure 2:
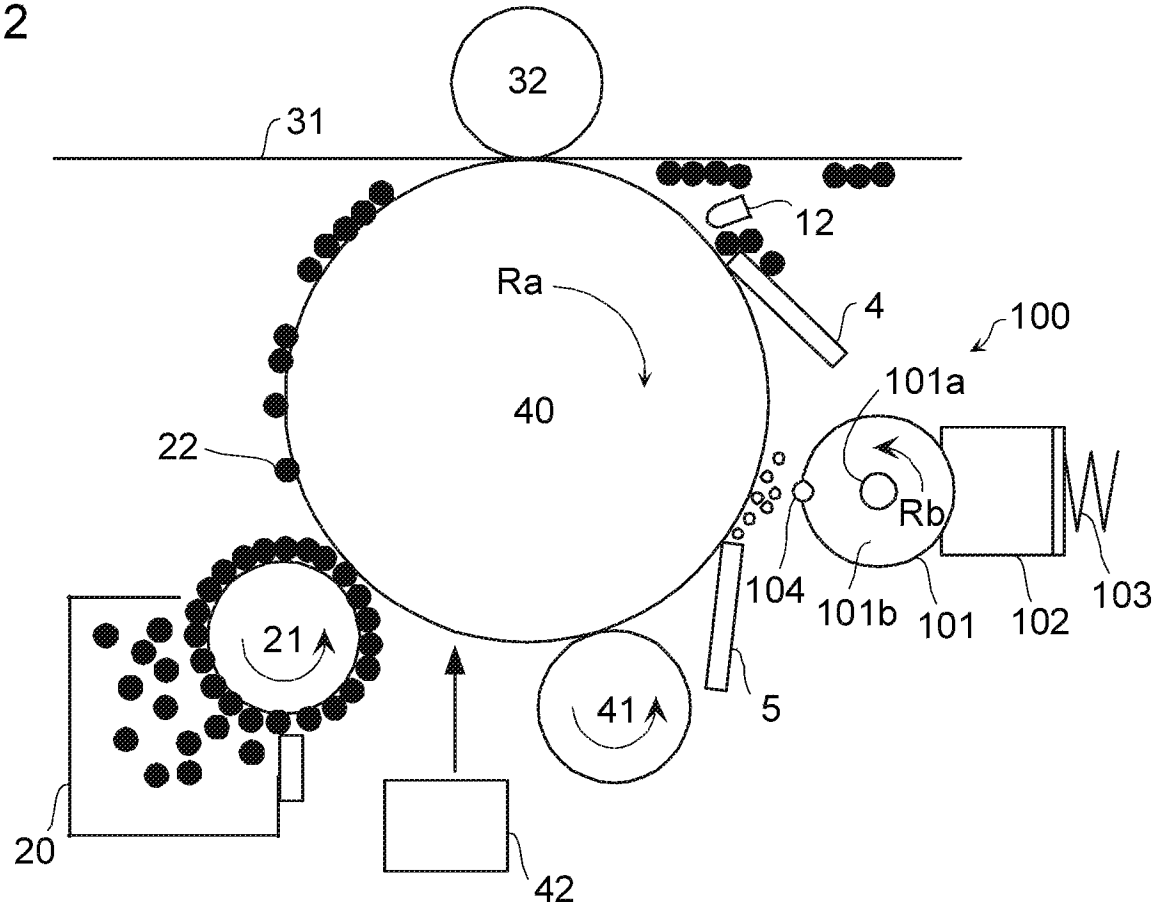
FIG. 2 is a schematic diagram illustrating a cross-sectional view of a photosensitive drum and adjacent components according to an example of the image forming apparatus.

FIG. 2 is a cross-sectional view schematically showing the vicinity of the photosensitive drum (also called an image carrier or a rotating member) 40 in the example image forming apparatus 1 shown in FIG. 1. FIG. 2 shows a state where a toner image is formed on the transfer belt 31 where reference numeral 22 denotes toner.

With reference to FIG. 2, an example image forming apparatus 1 may include a primary transfer roller 32, a static elimination device 12, a cleaning blade 4, a lubricant application device 100, a blade (or an auxiliary blade) 5, a charging roller 41, an exposure unit (or exposure device) 42, a developing device 20 and others positioned about the photosensitive drum 40, for example space along a rotational direction Ra of the photosensitive drum 40. The charging roller 41, the exposure unit 42 and the developing device 20 may be similar to the corresponding components described above.

After the toner image is primarily transferred from the photosensitive drum 40 to an intermediate transfer body (for example, transfer belt 31), the static elimination device 12 may irradiate light to the photosensitive drum 40 to remove a charge remaining on the photosensitive drum 40. The cleaning blade 4 which can be part of the cleaning unit 44, can collect toner remaining on the photosensitive drum 40 (residual toner after transfer). The cleaning blade 4 can be formed of an elastic body such as urethane rubber. The cleaning blade 4 is configured so as to be pressed against the surface of the photosensitive drum 40 to scrape off the residual toner on the surface of the photosensitive drum 40, after transferring the developed toner image from the photosensitive drum 40.

The blade (or auxiliary blade) 5 can uniformly layer fine particles of the lubricant applied on the surface of the photosensitive drum 40. The blade 5 can be formed of an elastic body such as urethane rubber to prevent or inhibit damaging the surface of the photosensitive drum 40. The blade 5 is configured to be pressed against the surface of the photosensitive drum 40. In other examples, the blade 5 can also serve as a cleaning blade, and in this case, the cleaning blade 4 can be omitted.

In the blade 5, a stick slip phenomenon is caused by a rotation of the photosensitive drum 40. When fine particles of the lubricant applied on the surface of the photosensitive drum 40 are, for example, about 2 μm (micron) or larger in size, these fine particles cannot enter into the stick slip movement and may be removed from the surface of the photosensitive drum 40 by the blade 5. The size of fine particles of the lubricant to be applied on the surface of the photosensitive drum 40 may be about 1 (micron) or less.

An example lubricant application device 100 can apply a lubricant to a surface of an image carrier (for example, photosensitive drum 40) with a low friction with the surface in order to protect the image carrier and maintain low friction. The example lubricant application device 100 includes a grinding roller 101 disposed separate (spaced apart) from the surface of the photosensitive drum 40 at a position facing the surface of the photosensitive drum 40, a solid lubricant source 102, an urging member 103 for urging the lubricant source 102 against the grinding roller 101, and a scattering member 104. Accordingly, the grinding roller 101 is spaced apart (in a non-contact manner) from the surface of the photosensitive drum 40 such that the grinding roller 101 does not contact the surface of the photosensitive drum 40, in order to prevent or inhibit damaging the surface of the photosensitive drum 40. The grinding roller 101 is located between a cleaning blade 4 and a blade 5 along the periphery of the photosensitive drum 40. In some examples, the grinding roller 101, the lubricant source 102, the urging member 103, the scattering member 104, the blade 5 and other components can be attached to a housing, to form a cleaning unit 44.

The solid lubricant source 102 can be a molded body obtained, for example, by molding a lubricant into a predetermined shape (rod-shaped, rectangular column or cylindrical shape). The lubricant source 102 can be composed of a stearic acid-based metallic soap such as zinc stearate, barium stearate and lead stearate.

The grinding roller 101 has a rotatable axial portion (or axle) 101*a*, and an elastic body 101*b* formed on a peripheral surface of the axial portion 101*a*. The axial portion 101*a* has opposite ends that can be rotatably supported by bearing members, and the axial portion 101*a* can be rotated and driven by a driving device. The elastic body 101*b* of the grinding roller 101 can be formed of, for example, radially-extending bristles or fibers. For example, the elastic body 101*b* may include a brush-shaped elastic body and the grinding roller 101 may be a brush roller. The radially-extending bristles or fibers can have flexibility, and can include resin fibers of, for example, polyolefin-based resins (for example, polyethylene or polypropylene), polyester-based resins (for example, polyethylene terephthalate: PET), acrylic resins (for example, poly(methyl methacrylate) (PMMA)), and polyamide-based resins (for example, nylon). For example, PET may be selected to increase durability. In addition, the elastic body 101*b* can be formed of foam (foam layer), instead of the form of a brush. For example, the elastic body 101*b* can be a sponge-like elastic body. The foam can include, for example, urethane foam.

FIG. 2 shows that the grinding roller 101 rotates in a rotational direction Rb opposite to the rotational direction Ra of the photosensitive drum 40. In some examples, the grinding roller 101 can be driven to rotate in the same direction as the rotational direction Ra of the photosensitive drum 40. In some examples, whenever a time period of use of the image forming apparatus 1 reaches a predetermined level, the rotational direction of the grinding roller 101 can be changed. For example, when the grinding roller 101 is a brush roller, a change of the rotational direction can eliminate or reduce bristle falling of the grinding roller 101, for example the tendency for the bristles to bend relative to the radial direction of the grinding roller 101.

The scattering member 104 can be disposed to contact the elastic body 101*b* of the grinding roller 101 at a position facing the surface of the photosensitive drum 40 and at an outer periphery of the grinding roller 101. In some examples, the scattering member 104 can be a single rod-shaped member. In some examples, the rod-shaped member can be composed of a metal such as stainless steel. In addition, this rod-shaped member can be a round rod. The elastic body 101*b* of the grinding roller 101 rotates in engagement with the solid lubricant source 102 to scrape off the lubricant and carry fine particles of the lubricant. Then, the elastic body 101*b* carrying the lubricant is in contact or engagement with the scattering member 104, to as to deform the elastic body 101*b* where the elastic body 101*b* contacts the scattering member 104. When the elastic body 101*b* is disengaged from the scattering member 104, the elastic body 101*b* can return to the original state. For example, when the elastic body 101*b* is brush-shaped, radially-extending bristles are curved in engagement with the scattering member 104; and when it becomes disengaged from the scattering member 104, it returns to the original state or shape (e.g., to extend substantially radially). A series of operations including allowing this elastic body 101*b* to be in contact (engagement) with the scattering member 104 and to be deformed, and then returning to the original state are carried out, to pulverize fine particles of the lubricant carried by the elastic body 101*b* to be reduced to smaller fine particles, which can be flicked out and scattered toward the surface of the photosensitive drum 40. The example lubricant application device 100 may generate fine particles of the lubricant applied to the surface of the photosensitive drum 40 having a size of about 1 μm (micron) or less.

Figure 3:
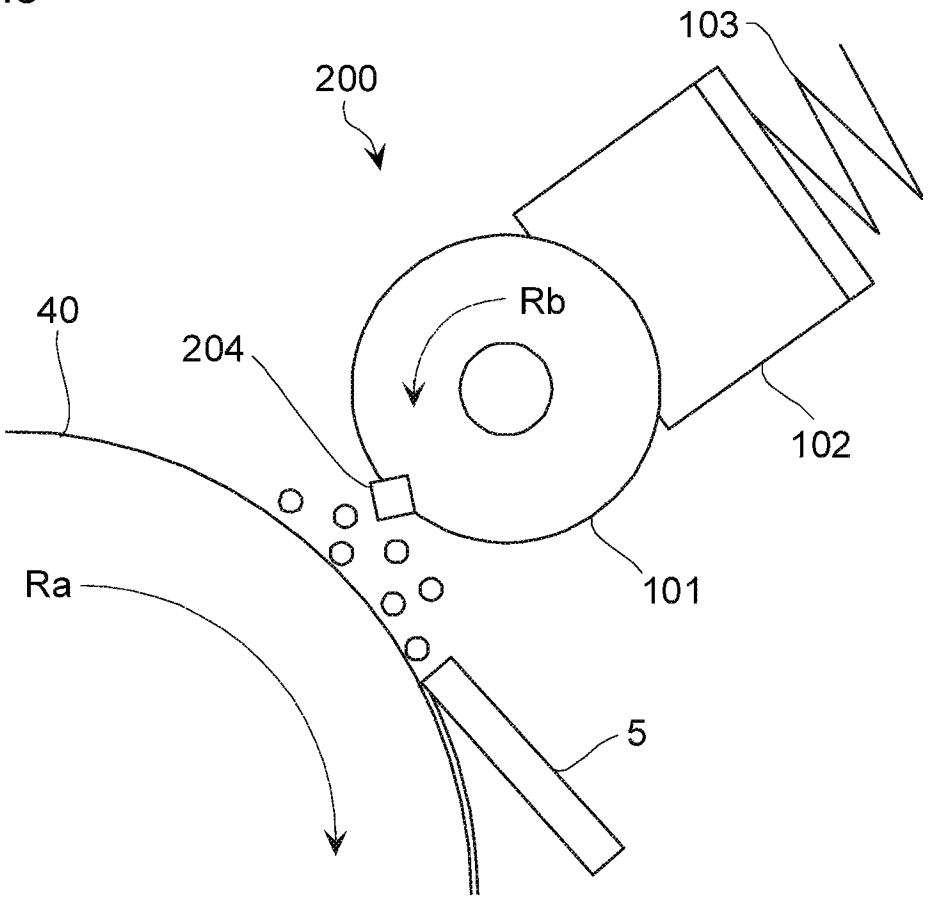
FIG. 3 is a schematic diagram illustrating an example lubricant application device.

FIG. 3 schematically shows a lubricant application device 200 according to another example. The example lubricant application device 200 has a scattering member 204. The scattering member 204 can be a single rod-shaped member. For example, the rod-shaped member can be made of a metal such as stainless steel, and can be a rectangular column (e.g., having a rectangular cross-section).

Figure 4:
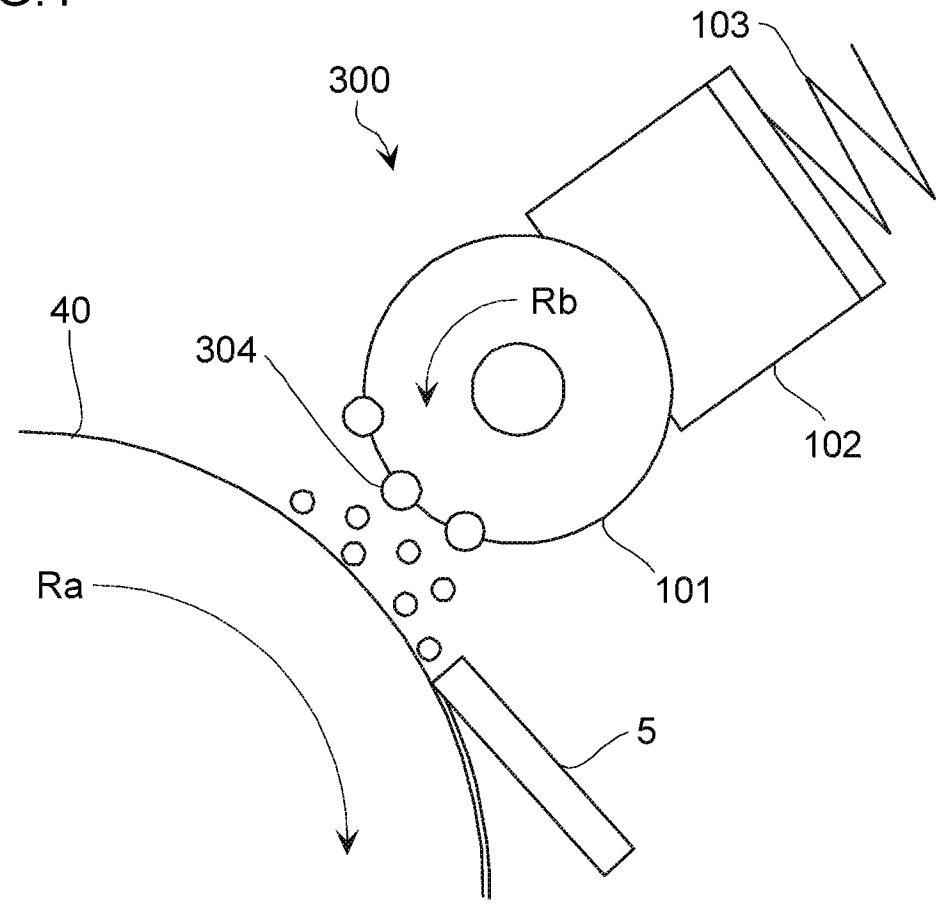
FIG. 4 is a schematic diagram illustrating an example lubricant application device.

FIG. 4 schematically shows a lubricant application device 300 according to still another example. The example lubricant application device 300 has a scattering member 304 which can be disposed to contact the elastic body 101*b* of the grinding roller 101 at an outer periphery of the grinding roller 101 and at a position or region facing the surface of the photosensitive drum 40. In some examples, the scattering member 304 can be composed of three rod-shaped members. For example, the rod-shaped members can be made of a metal such as stainless steel. With reference to FIG. 4, each of the rod-shaped members may include a round rod (e.g., having a circular cross-section). In some examples, the scattering member 304 can also be a rectangular column. In addition, although the example of FIG. 4 shows the scattering member 304 as having three rod-shaped members, the number of the rod-shaped members can be two or four, or more, depending on examples. When the elastic body 101*b* is a sponge-like elastic body, the scattering member 304 may include a round rod as shown in FIG. 4, to inhibit damaging the sponge-like elastic body.

The example rod-shaped scattering members 104, 204 and 304 shown in FIGS. 2 to 4, respectively, each have a central axis, and is configured to be rotatable about the central axis. For example, each of the rod-shaped scattering members 104, 204 and 304 is positioned to contact the rotating grinding roller 101 to be thereby freely rotatable, to prevent a lubricant from being fixed or deposited on the rod-shaped scattering member. In some examples, each of the rod-shaped scattering members 104, 204 and 304 may be driven and rotated about the central axis by a driving device.

Figure 5:
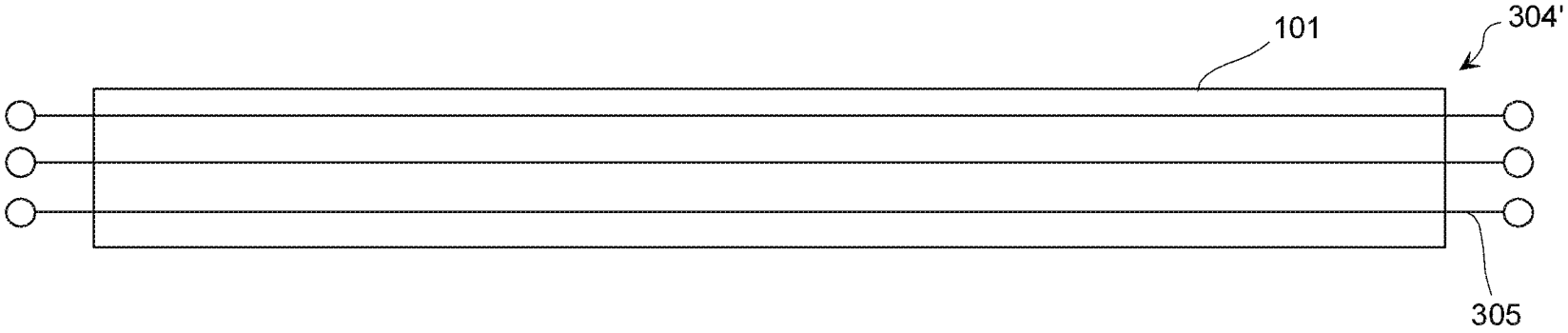
FIG. 5 is a schematic diagram illustrating an example scattering member.

FIG. 5 shows another example scattering member 304'. FIG. 5 illustrates the scattering member 304' as viewed from the side of the photosensitive drum 40. In some examples, the scattering member 304' may include wires 305 that are tensioned in a longitudinal direction of the grinding roller 101. Although FIG. 5 shows an example where the scattering member 304' includes three wires 305, the number of wires may be one, two or four, or more, depending on examples. In some examples, the wire 305 can vibrate by contacting the grinding roller 101, to prevent the lubricant from being fixed or deposited on the wire 305, and to pulverize fine particles of the lubricant carried by the elastic body 101*b* of the grinding roller 101 and scatter the fine particles toward the surface of the photosensitive drum 40 more efficiently.

Figure 6:
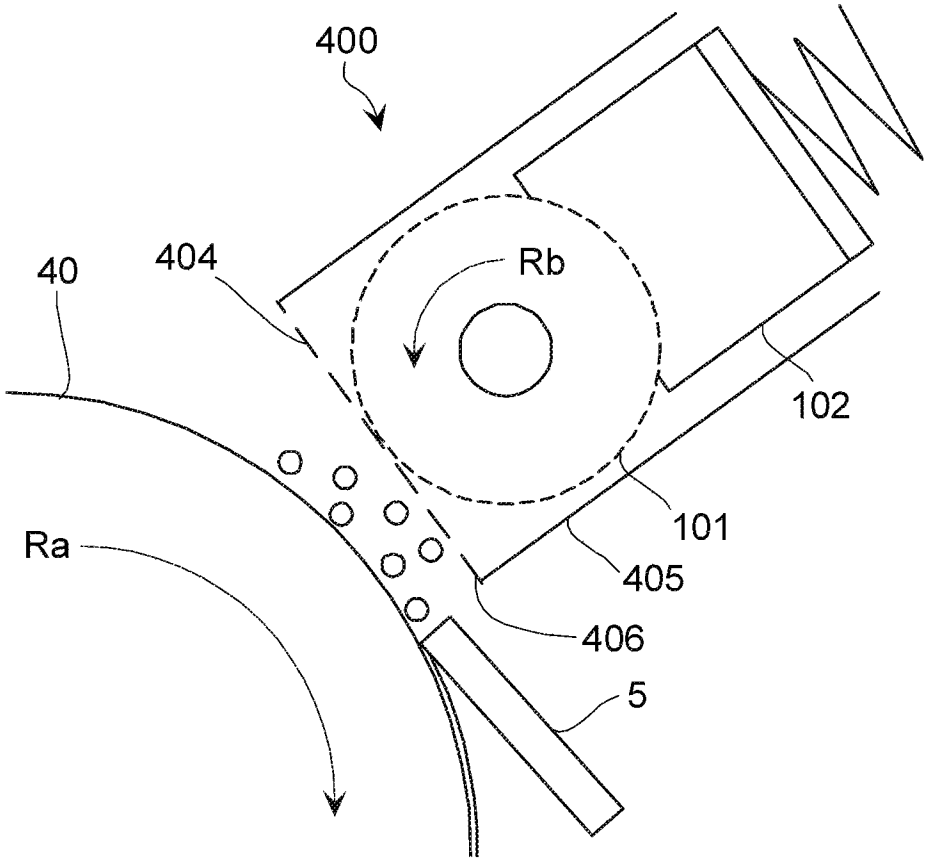
FIG. 6 is a schematic diagram illustrating an example lubricant application device.

FIG. 6 schematically shows a lubricant application device 400 according to still another example. The example lubricant application device 400 has a scattering member 404 and a case 405. The scattering member 404 can be disposed to contact the elastic body 101*b* of the grinding roller 101 at an outer periphery thereof and at a position facing the surface of the photosensitive drum 40. The scattering member 404 can be a perforated member, made of a metal such as stainless steel, formed into a flat plate. The case 405 can be configured to enclose the grinding roller 101 and the lubricant source 102. The case 405 has an opening (or an open end) 406 at a portion where the grinding roller 101 faces the photosensitive drum 40. The scattering member (perforated member) 404 can be disposed at the opening (or open end) 406. The case 405 prevents fine particles of the lubricant from being scattered to locations other than the photosensitive drum 40. The lubricant application devices 100, 200 and 300, schematically illustrated in FIGS. 2, 3 and 4 can also include a case in a similar manner as the lubricant application device 400 of FIG. 5.

Figure 7:
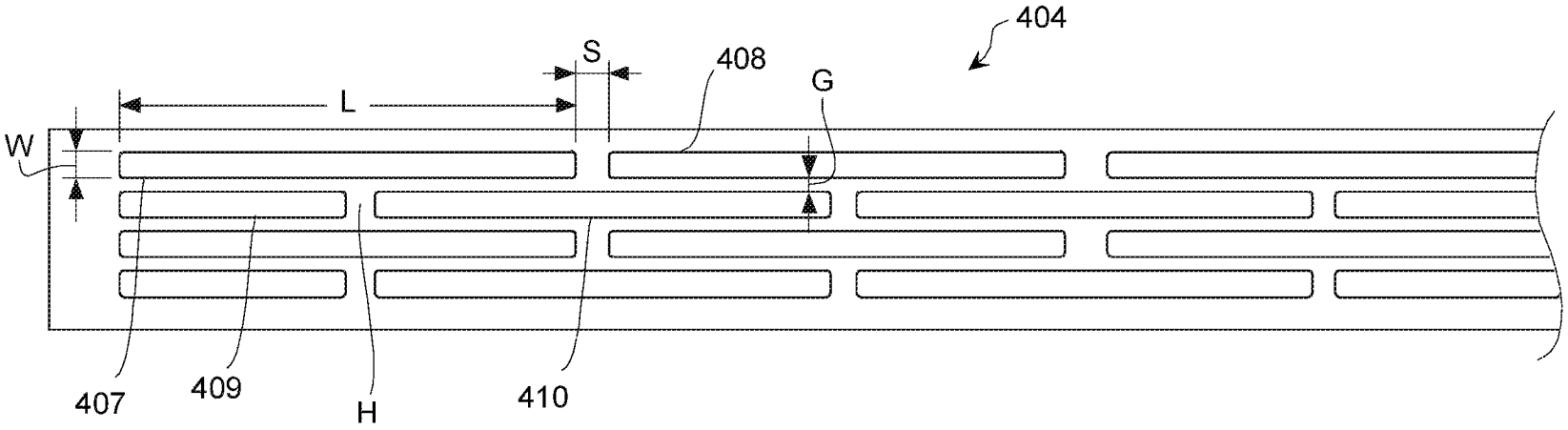
FIG. 7 is a schematic diagram illustrating a partial view of an example scattering member.

FIG. 7 is a top view showing a part of an example perforated member 404. The perforated member 404 has a plurality of openings or holes 407, 408, 409 and 410. The perforated member 404 can be produced by making openings (holes) in a metal plate by methods of etching, etc. The opening (hole) 407 has a length L in the longitudinal direction of the grinding roller 101 and a width W in a rotational direction of the grinding roller 101 (or in a width direction of the grinding roller 101 that is perpendicular to the longitudinal direction). The length L of the opening 407 can be about 0.5 mm to about 10 mm. When the grinding roller 101 is a brush roller, the length L of the opening 407 may be limited in size to maintain or promote the longitudinal stiffness such that the perforated member 404 is not deflected by a torque applied by the rotation of the brush. Additionally, the length L may have a minimum size to prevent the bristles of the brush from gathering at the opening 407 which may inhibit the suitable pulverizing of particles of the lubricant. In addition, the width W of the opening 407 can be of about 0.5 mm to about 2 mm. The width W may have a minimum size to prevent bristles of the brush from gathering at the opening which may inhibit pulverizing of the particles of the lubricant. Additionally, the width W may be limited in size to prevent particles of the lubricant from being scattered before the bristles of the brush collide with an edge of the opening which may inhibit pulverizing the particles of the lubricant. A space S between the openings 407 and 408 adjacent to each other in the longitudinal direction, can be of about 0.2 mm to about 0.5 mm. A gap G between the openings 408 and 410 adjacent to each other in the rotational direction (or in the width direction of the openings) can be of about 0.2 mm to about 0.5 mm. As illustrated, the openings 409 and 410 of a second row can be positioned to be offset from alignment with the openings 407, 408 of the first row, such that a portion (metal portion) H not opened between the openings 409 and 410 is aligned in the width direction with a central portion of the opening 407. For example, the openings 407 and 408 of the first row; and the openings 409 and 410 of the second row can be alternately arranged. In this case, the longitudinal length of the opening 409 arranged at an end portion of the perforated member 404 can be approximately a half of the length L of the adjacent opening 407. However, the arrangement of the openings is not limited to the alternate arrangement described above. For example, the opening 407 of the first row may be aligned with the opening 409 of the second row. In addition, although the shape of the opening 407 in FIG. 7 has a rectangular shape, the opening(s) (or hole(s)) can be formed in other shapes such as a round shape or an oval shape, for example.

Figure 8:
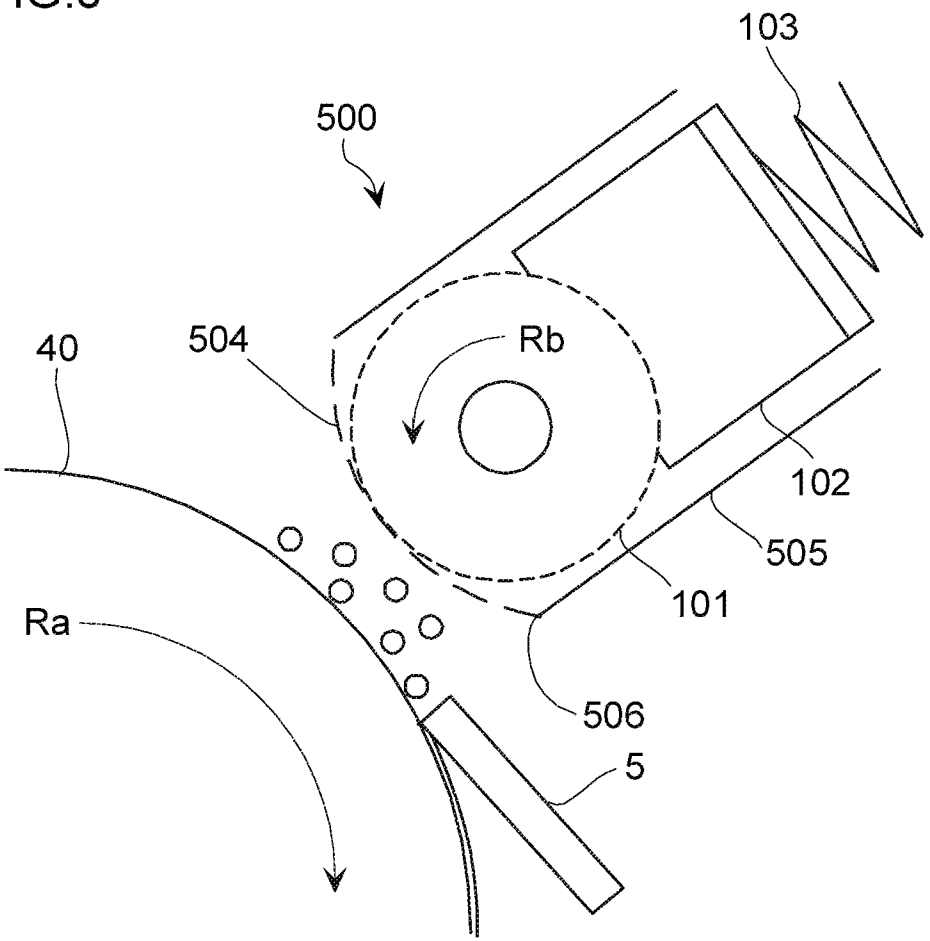
FIG. 8 is a schematic diagram illustrating an example lubricant application device.

FIG. 8 schematically shows a lubricant application device 500 according to still another example of the present disclosure. The example lubricant application device 500 has a scattering member 504 and a case 505. In the example of FIG. 8, the scattering member 504 can be disposed to contact the elastic body 101*b* of the grinding roller 101 at an outer periphery of the grinding roller 101 and at a position facing the surface of the photosensitive drum 40. The scattering member 504 can be a perforated member made of a metal, and that is curved along the outer periphery of the grinding roller 101. This perforated member 504 can include a similar arrangement of openings as the perforated member 404 shown in FIG. 7. The case 505 can be configured to enclose the grinding roller 101 and the lubricant source 102 in similarly to the above-described case 405. The case 505 has an opening (or open end) 506 at a portion where the grinding roller 101 faces the photosensitive drum 40. The scattering member (perforated member) 504 can be disposed at the opening (open end) 506.

Figure 9:
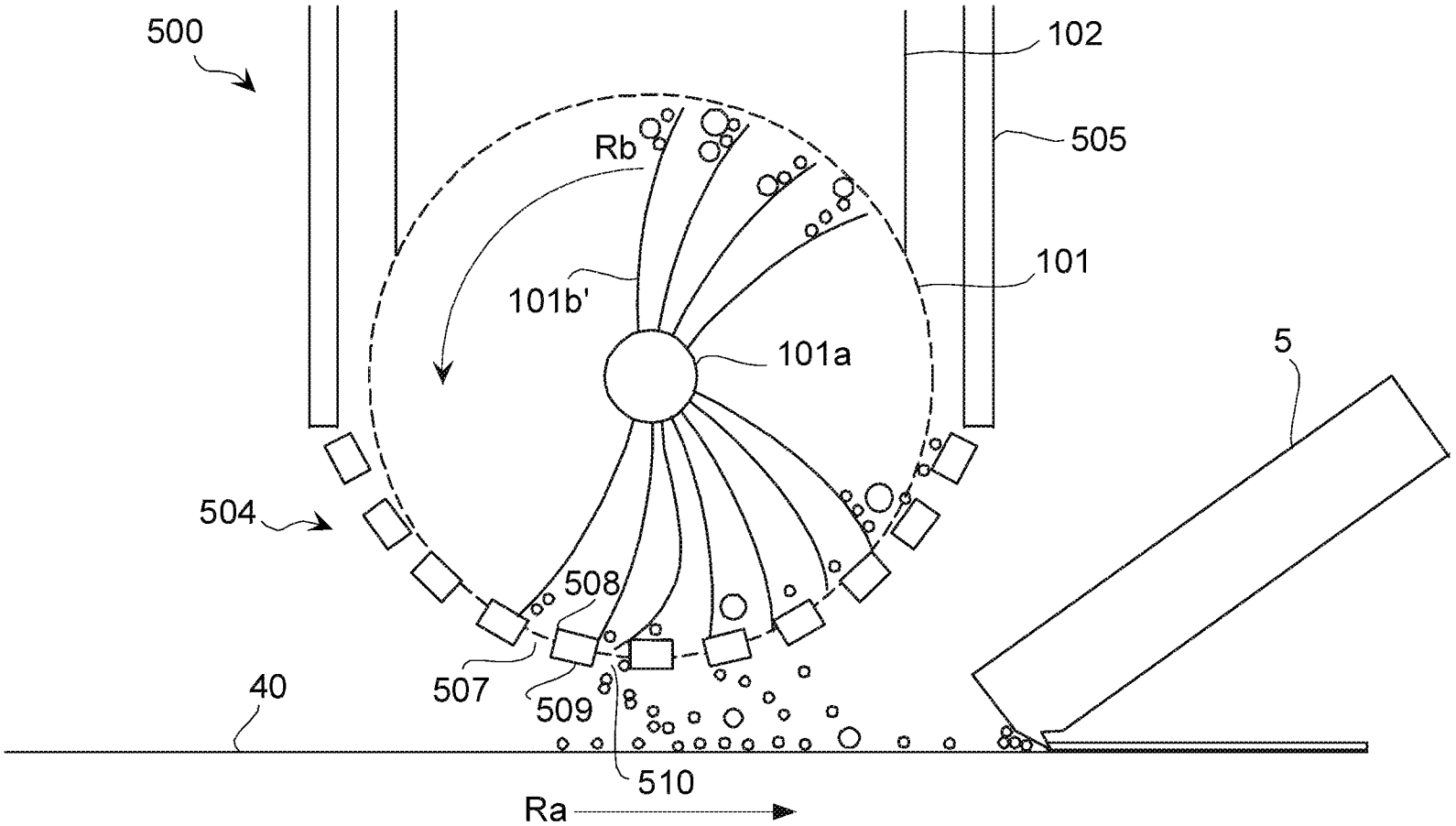
FIG. 9 is a schematic diagram illustrating a partial enlarged view of the example lubricant application device shown in FIG. 8.

FIG. 9 is an enlarged view of a part of the example lubricant application device 500. In FIG. 9, the grinding roller 101 is indicated as a brush roller. For example, brush bristles 101*b*' of the grinding roller 101 rotate in engagement with the solid lubricant source 102 to scrape off a lubricant and carry fine particles of the lubricant. By a rotation of the grinding roller 101, the bristles 101*b*' carrying the lubricant come into contact with the perforated member 504. The bristles 101*b*' collide with (or are impinged by) an edge 508 of an opening (or hole) 507 of the perforated member 504 and are deformed when they pass through a closed portion (metal portion) 509 other than the openings (holes) of the perforated member 504. The carried fine particles of the lubricant can be pulverized by the collision to form smaller fine particles. When the bristles 101*b*' are rotated beyond the closed portion (metal portion) 509 other than the openings and enter another opening 510, the bristles 101*b*' attempt to return to the original state. Such an operation of attempting to return to the original state enables fine particles of the lubricant carried on the bristles 101*b*' to be flicked out and scattered toward the surface of the photosensitive drum 40. The pulverizing and scattering operations can be repeated at multiple openings (holes) 507 and 510 of the perforated member 504.

Figure 13A:
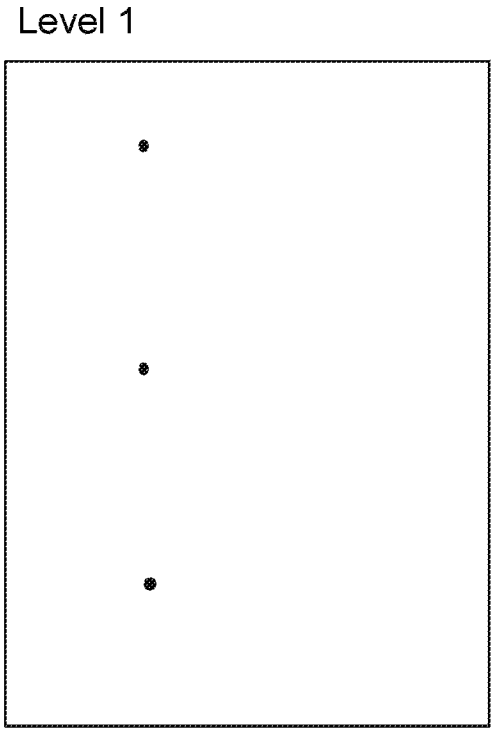
FIG. 13A is a schematic representation of a stripe-like image on a printed sheet, including spots.
Figure 13B:
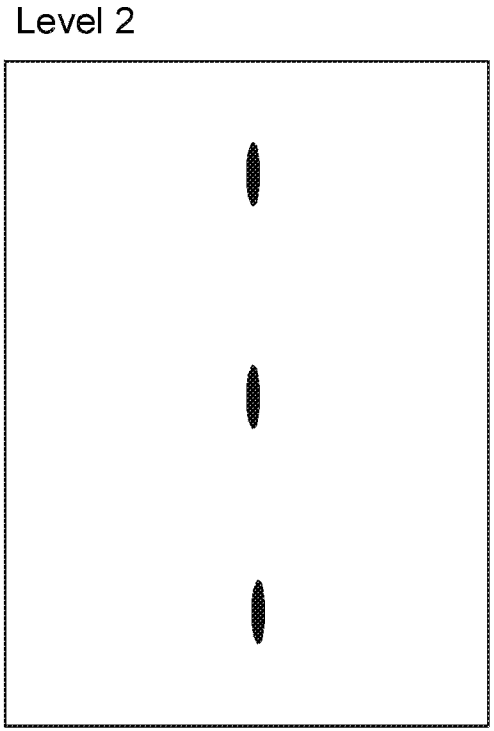
FIG. 13B is a schematic representation of a stripe-like image on a printed sheet, including longitudinal spots.
Figure 13C:
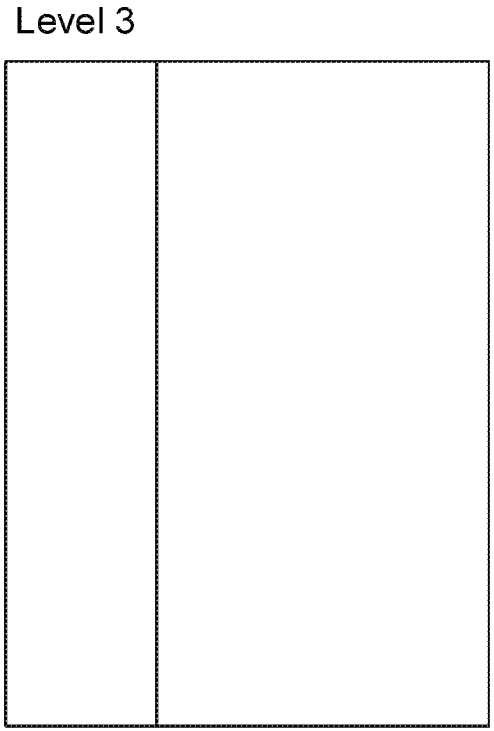
FIG. 13C is a schematic representation of stripe-like image on a printed sheet, including stripes.

Experiments were carried out with lubricant application devices similar to the lubricant application devices 100, 200, 300, 400 and 500, and the performance results will be described. For convenience, the lubricant application devices 100, 200, 300, 400 and 500 are referred to as Configurations 1, 2, 3, 4 and 5, respectively. A long-term use of the lubricant application device may generate, for example, application unevenness or the like of the lubricant due to deterioration of the grinding roller or the like, which may cause an image defect of vertical stripe (or stripe-like image defect) during printing. Table 1 shows conditions in which image defects of vertical stripe (or stripe-like image defect) occurred when printing half tone images experimentally and continuously by an image forming apparatus having each of Configurations 1 to 5. Level 0 indicates that no vertical stripe is generated on a paper sheet. Level 1 indicates that a color spot or white spot is generated on a paper sheet for every rotation cycle (period) of the photosensitive drum (cf. FIG. 13A). Level 2 indicates that a longitudinal color spot or white spot is generated on a paper sheet for every rotation cycle of the photosensitive drum (cf. FIG. 13B). Level 3 indicates that a color or white stripe is generated on a paper sheet in a direction for feeding a paper sheet (cf. FIG. 13C). In Table 1, the number of prints are expressed in kilo print volume (kpv) representing the number of printed sheets. For example, Table 1 indicates that one paper sheet (1 pv) is printed with four rotations or revolutions (four cycles) of a photosensitive drum.

TABLE 1

| Cycle number of photosensitive drum (kcycle) | Number of prints (kpv) | Configuration 1 | Configuration 2 | Configuration 3 | Configuration 4 | Configuration 5 |
|---|---|---|---|---|---|---|
| 500 | 125 | 0 | 0 | 0 | 0 | 0 |
| 1000 | 250 | 0 | 0 | 0 | 0 | 0 |
| 1500 | 375 | 0 | 0 | 0 | 0 | 0 |
| 2000 | 500 | 1 | 0 | 0 | 0 | 0 |
| 2500 | 625 | 1 | 1 | 1 | 0 | 0 |
| 3000 | 750 | 2 | 2 | 1 | 0 | 0 |

At 2000 kcycles of rotation of the photosensitive drum and 500 kpv of sheets printed, Configuration 1 generates a stripe-like image defect of Level 1 while Configurations 2 to 5 generates no stripe-like image defect. At 2500 kcycles of rotation of the photosensitive drum and 625 kpv of sheets printed, Configurations 1 to 3 generate a stripe-like image defect of Level 1 while Configurations 4 and 5 cause no stripe-like image defect. At 3000 kcycles of rotation of the photosensitive drum and 750 kpv of sheets printed, Configurations 1 and 2 generate a stripe-like image defect of Level 2 and Configuration 3 generates a stripe-like image defect of Level 1, while Configurations 4 and 5 generate no stripe-like image defect. Accordingly, based on the above results, the lubricant application device 400 (Configuration 4) and the lubricant application device 500 (Configuration 5) are less likely to cause unevenness in applying lubricant to the photosensitive drum.

Figure 14:
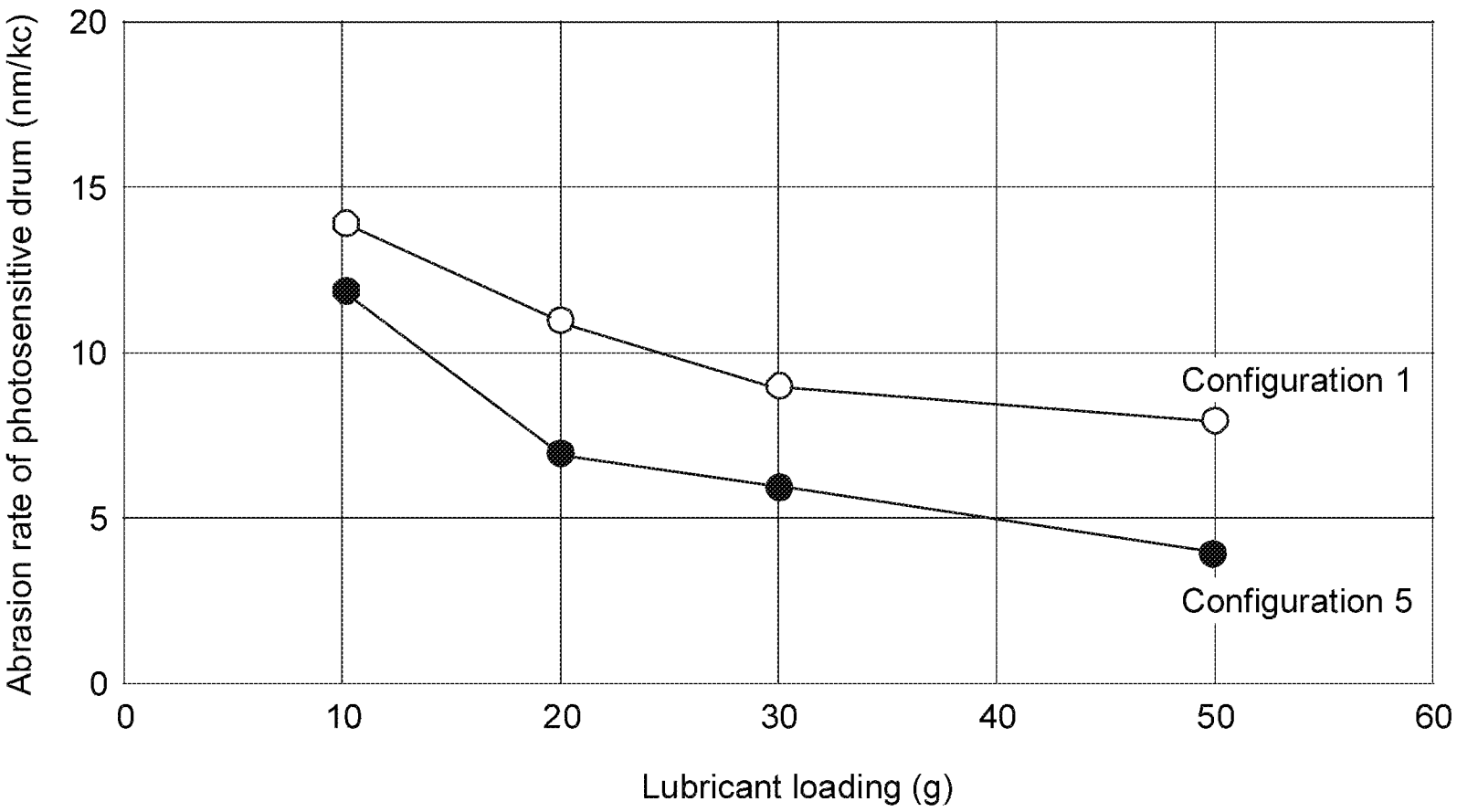
FIG. 14 is a graph showing an abrasion rate of a photosensitive drum relative to a lubricant loading for example image forming apparatuses.

FIG. 14 is a graph showing experimental results of abrasion rates of photosensitive drums with respect to a load for urging the lubricant source 102 toward the grinding roller (also referred to as a lubricant loading) in the example image forming apparatuses having Configurations 1 and 5, respectively. As the lubricant source loading increases, the grinding roller scrapes off more lubricant source. Thus, the lubricant source 102 is consumed faster which may not make an optimal use of the lubricant source. Accordingly, the lubricant loading may be set at a lower level to more efficiently apply the lubricant to the photosensitive drum. Based on the graph of FIG. 14, Configuration 5 tends to maintain the abrasion rate of the photosensitive drum lower than Configuration 1. Accordingly, regarding the application of the lubricant to the photosensitive drum, the above-described results indicate that Configuration 5 is more efficient than Configuration 1.

Figure 10A:
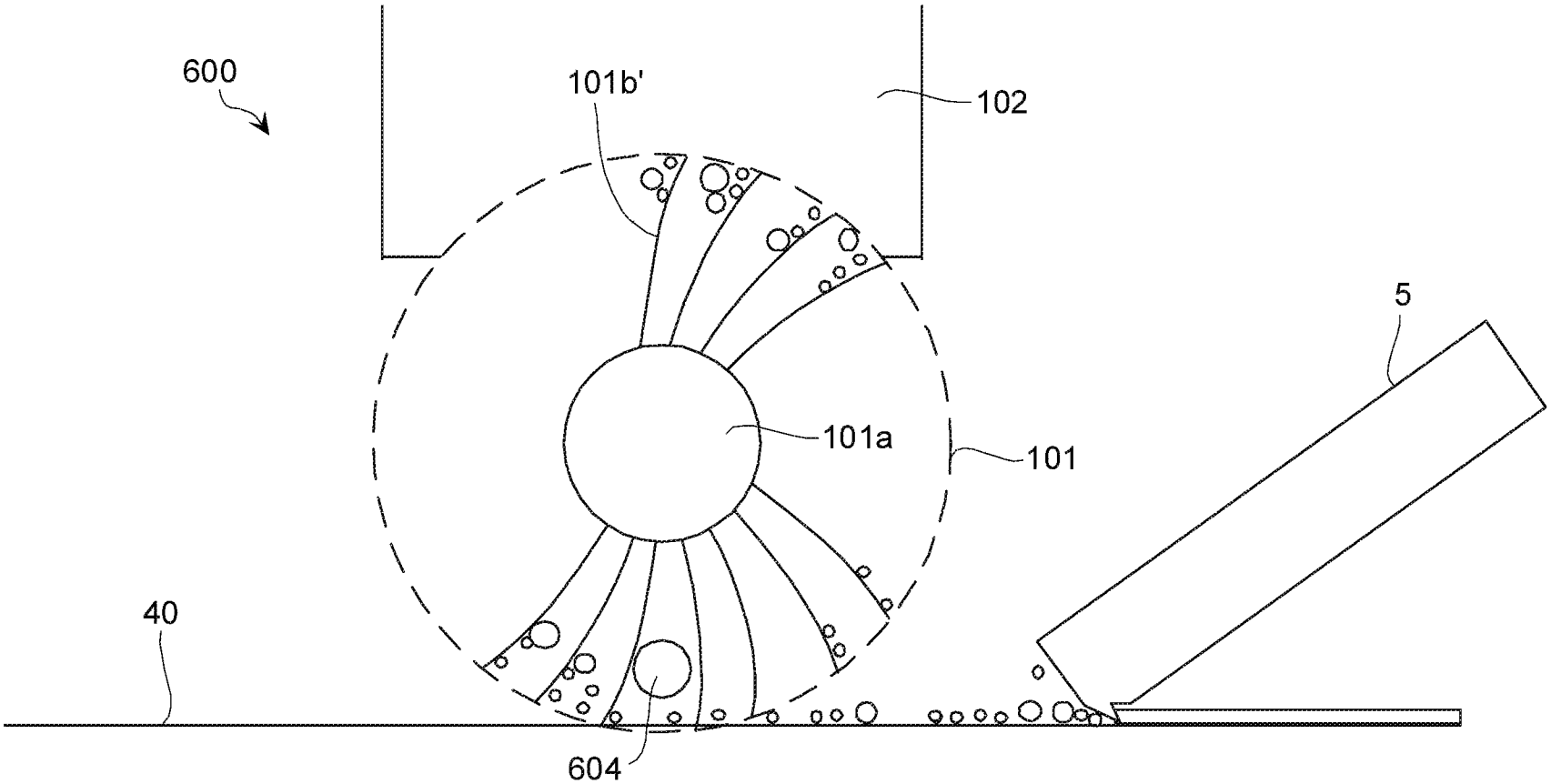
FIG. 10A is a schematic diagram illustrating an example lubricant application device having a grinding roller adjacent a photosensitive drum, shown in a state where the photosensitive drum and the grinding roller are stopped.
Figure 10B:
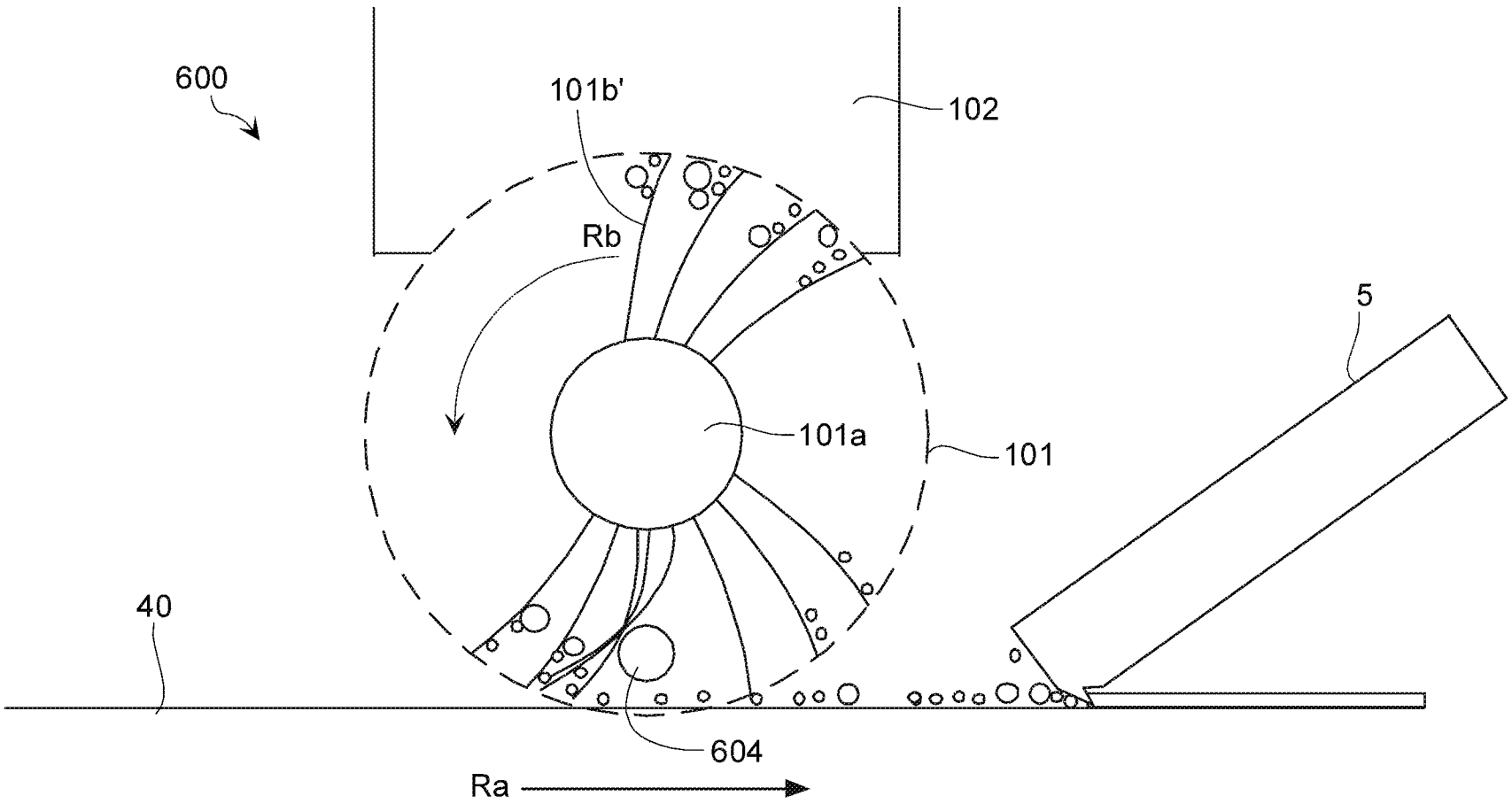
FIG. 10B is a schematic diagram of the example lubricant application device, shown a state where the photosensitive drum and the grinding roller are rotating.

FIGS. 10A and 10B schematically show a lubricant application device 600 according to still another example of the present disclosure. The example lubricant application device 600 includes a grinding roller 101 adjacent a photosensitive drum 40, and a scattering member 604. FIG. 10A shows a state where the photosensitive drum 40 and the grinding roller 101 are stopped from rotation. FIG. 10B shows a state where the photosensitive drum 40 and the grinding roller 101 are rotating. The grinding roller 101 is a brush roller, and the scattering member 604 can be a single rod-shaped member 104 as shown in FIG. 2. Although the scattering member 604 is indicated as a round rod, in some examples, the lubricant application device 600 may include a scattering member that is a rectangular column, similarly to the scattering member 304 shown in FIG. 3. In some examples, the scattering member 604 can include a plurality of rod-shaped members similarly to the scattering member 304 shown in FIG. 3. Referring to FIG. 10A, in the state where the photosensitive drum 40 and the grinding roller 101 are stopped (e.g., immobile, or not rotated), the lubricant application device 600 is disposed relative to the photosensitive drum 40 such that edges (or the tip ends) of the brush bristles 101*b*' of the grinding roller 101 contact the photosensitive drum 40.

The scattering member 604 can be disposed at a position facing the surface of the photosensitive drum 40 and between the center of the grinding roller 101 and the periphery (or outer edge) of the grinding roller 101 (e.g., at a position closer to the center of the grinding roller 101 than an outer peripheral surface of the grinding roller 101). As the position of the scattering member 604 tends to approach the rotational axis of the grinding roller 101, the load applied to the grinding roller 101 increases. Accordingly, the scattering member 604 may be positioned at a location of up to about 30% of the length of the brush bristles 101*b*' from the edges (or tip ends) of the bristles. When the photosensitive drum 40 and the grinding roller 101 are rotated as shown in FIG. 10B, the brush bristles 101*b*' of the grinding roller 101 become engaged with the rod-shaped member 604 and bent in order to avoid contact with the photosensitive drum 40. When the bristles 101*b*' are rotated to be released from the rod-shaped member 604, fine particles of the lubricant carried on the bristles 101*b*' can be scattered toward the photosensitive drum 40. Accordingly, in the lubricant application device 600, the grinding roller 101 contacts the photosensitive drum 40 when the grinding roller 101 is stopped and does not contact the photosensitive drum 40 when the grinding roller 101 is rotated.

Figure 11A:
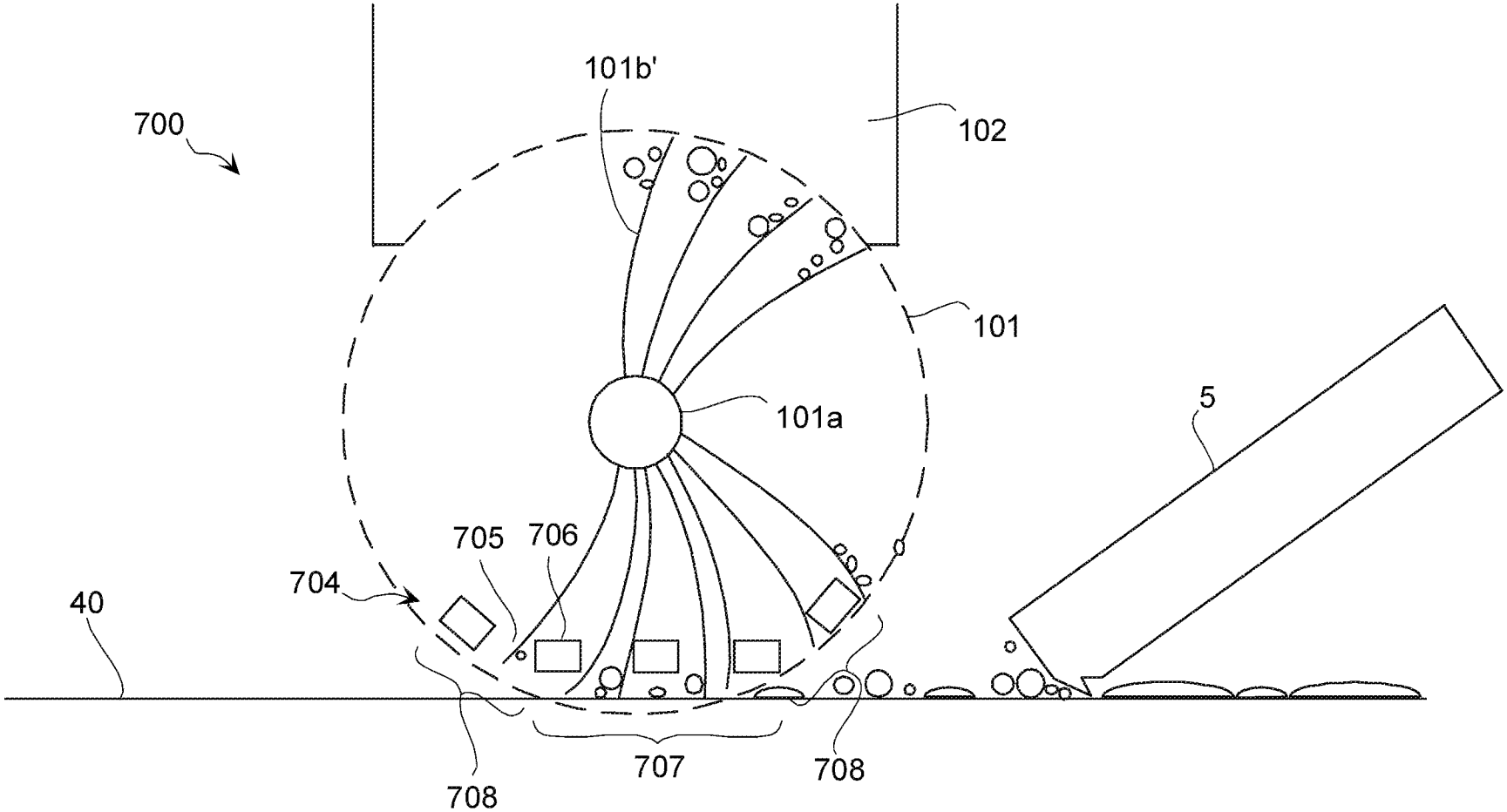
FIG. 11A is a schematic diagram illustrating an example lubricant application device including a grinding roller adjacent a photosensitive drum, shown in a state where the photosensitive drum and the grinding roller are stopped.
Figure 11B:
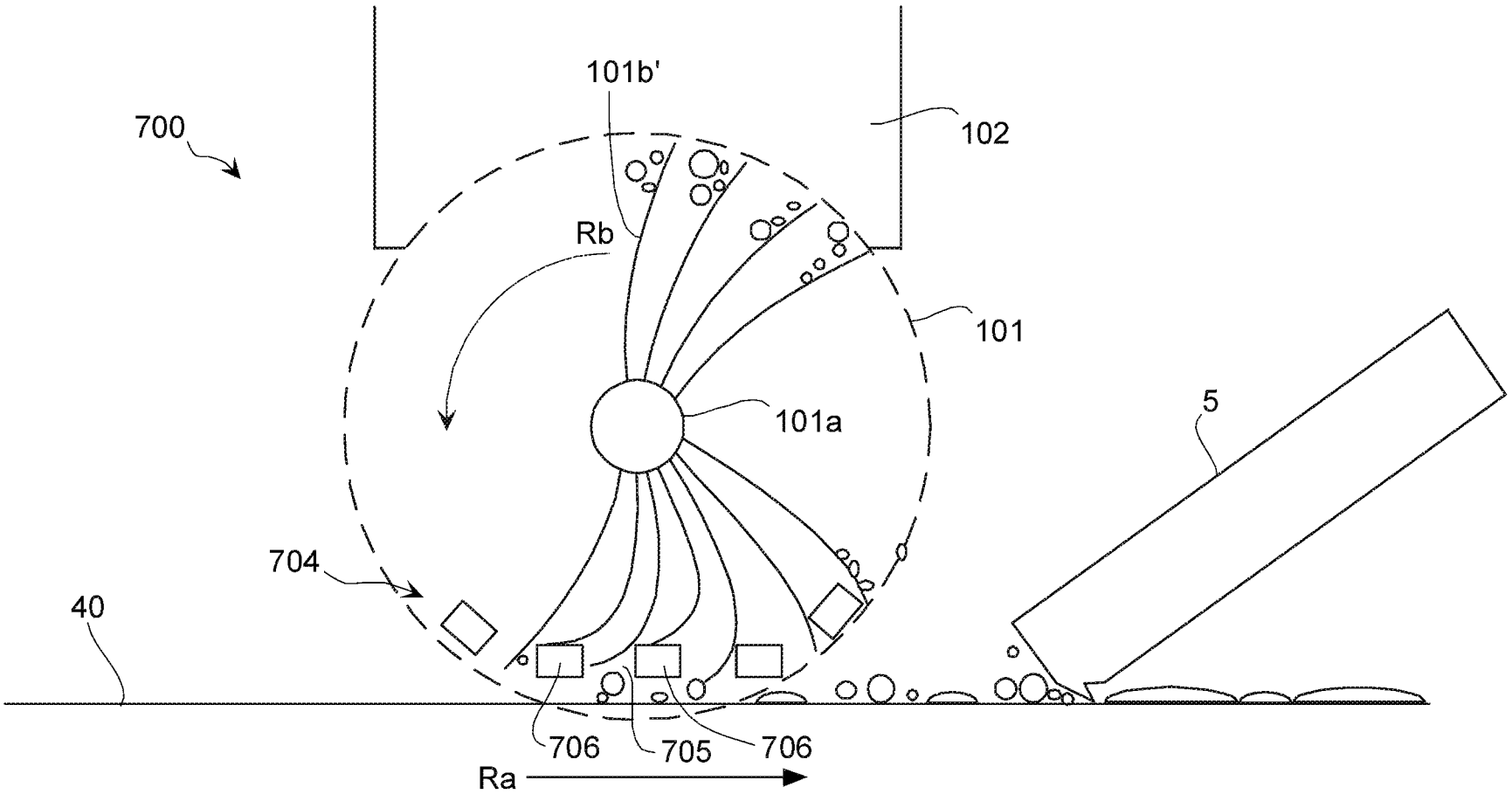
FIG. 11B is a schematic diagram of the example lubricant application device, shown in a state where the photosensitive drum and the grinding roller are rotating.

FIGS. 11A and 11B schematically show a lubricant application device 700 according to still another example of the present disclosure. The example lubricant application device 700 includes a grinding roller 101 adjacent a photosensitive drum 40, and a scattering member 704. FIG. 11A shows a state where the photosensitive drum 40 and the grinding roller 101 are stopped. FIG. 11B shows a state where the photosensitive drum 40 and the grinding roller 101 are rotating. The grinding roller 101 is a brush roller, and the scattering member 704 can be a perforated member made of a metal as shown in FIG. 7. The perforated member 704 has a central portion 707 that is substantially flat, and edge portions 708 extending at opposite sides of the central portion 707 that are curved along the outer periphery of the grinding roller 101. As shown in FIG. 11A, in a state where the photosensitive drum 40 and the grinding roller 101 are stopped, the lubricant application device 700 is disposed relative to the photosensitive drum 40 such that edges of brush bristles 101*b*' of the grinding roller 101 contact the photosensitive drum 40 through an opening 705.

The perforated member 704 has the central portion 707 that can be disposed between the center of the grinding roller 101 and the periphery or outer edge of the grinding roller 101 (e.g., at a position closer to the center of the grinding roller 101 than the outer peripheral surface of the grinding roller 101). As the position of the central portion 707 tends to approach the rotational axis of the grinding roller 101, the load applied to the grinding roller 101 increases. Accordingly, the central portion 707 may be positioned in a location of up to about 30% of the length of the brush bristles 101*b*' from the edges (or tip ends) of the bristles. When the photosensitive drum 40 and the grinding roller 101 are rotating as shown in FIG. 11B, the brush bristles 101*b*' of the grinding roller 101 are bent by a closed portion (e.g., metal portion) 706 other than the openings of the perforated member 704, they pass through the opening 705, and they reach another closed portion (e.g., metal portion) 706 other than the openings. In this case, when the brush bristles 101*b*' of the grinding roller 101 pass through the opening 705, they tend to return to their original state (e.g., initial shape of the brush bristles 101*b*'). However, before they return to the original state (that is, a state where they contact the photosensitive drum 40), they reach the closed portion (metal portion) 706 other than the openings and are bent. Accordingly, when the grinding roller 101 is rotated, the grinding roller 101 does not contact the photosensitive drum 40.

Figure 12:
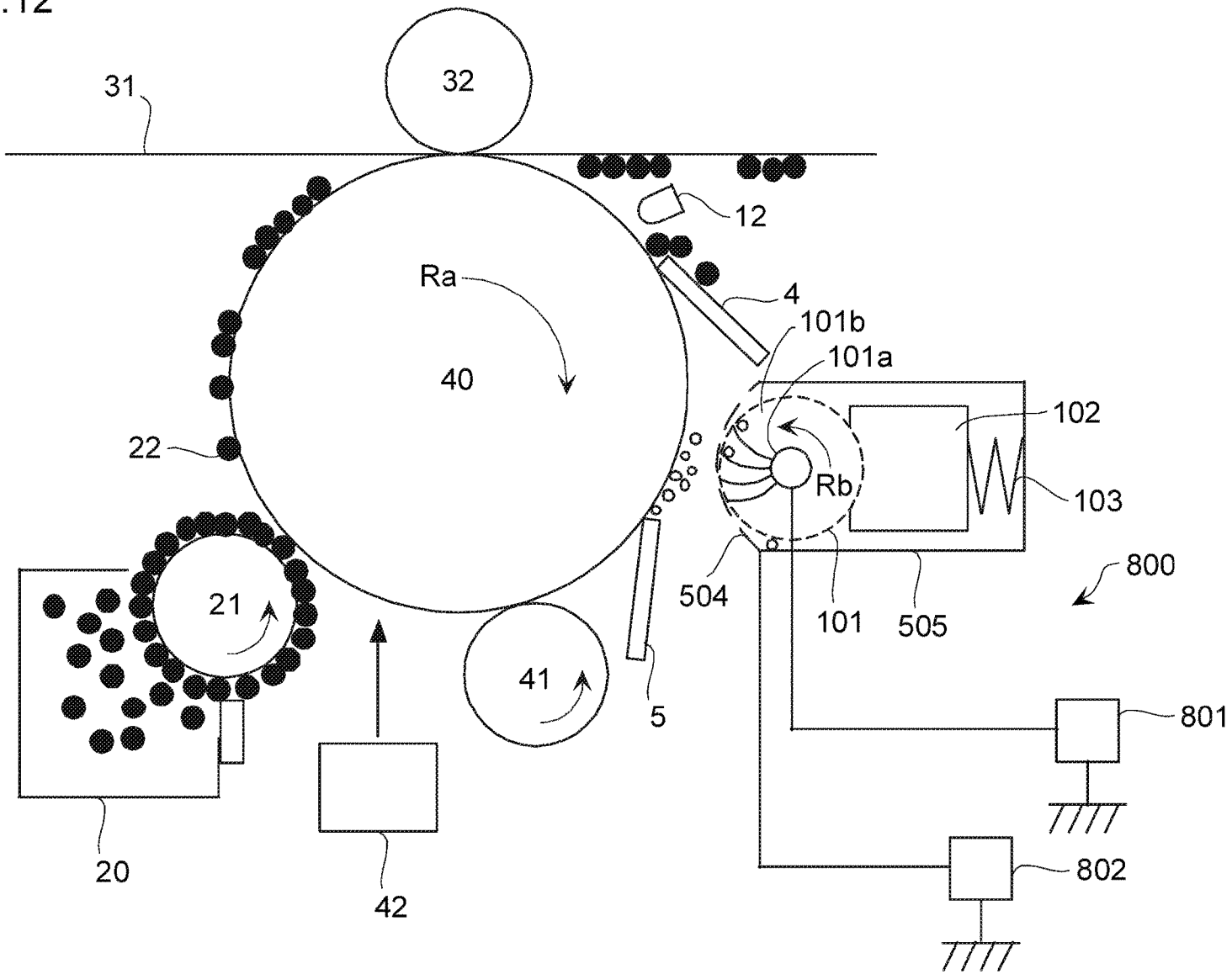
FIG. 12 is a schematic diagram illustrating a cross-sectional view of a photosensitive drum and a lubricant application device in an example image forming apparatus according to an example of the present disclosure.

FIG. 12 is a cross-sectional view schematically showing the vicinity of the photosensitive drum of an image forming apparatus having a lubricant application device 800 according to still another example of the present disclosure. The example lubricant application device 800 may be similar to the lubricant application device 500 shown in FIGS. 8 and 9 according to some examples, or in other examples, the lubricant application device 800 may be configured similarly to any one of the lubricant application devices 100, 200, 300, 400, 600 or 700, with reference to FIGS. 2 to 4, FIG. 6, FIGS. 10A and 10B, and FIGS. 11A and 11B. In the lubricant application device 800, an axial portion 101*a* of the grinding roller 101 can be conductive. The axial portion 101*a* can be made of a metal such as iron, copper, aluminum or stainless steel. In addition, an elastic body 101*b* of the grinding roller 101 can also be conductive. In the example of FIG. 12, the grinding roller 101 is indicated as a brush roller. A conductive brush can be a brush made of, for example, a resin such as polyolefin-based resins (for example, polyethylene or polypropylene), polyester-based resins (for example, polyethylene terephthalate: PET), acrylic resins (for example, poly(methyl methacrylate) (PMMA)), and polyamide-based resins (for example, nylon), to which the conductivity is imparted. For example, PET may be selected to improve durability.

The example lubricant application device 800 includes a first voltage source 801 to apply a voltage to the elastic body 101*b* through the axial portion 101*a* of the grinding roller

101, and a second voltage source 802 to apply a voltage to the scattering member (perforated member made of a metal) 504. In some examples, the first voltage source 801 can generate a DC voltage of about −200 V to about −400 V and the second voltage source 802 can generate a DC voltage of about 0 V to about −200 V. In some examples, the first voltage source 801 can generate a DC voltage of about −400 V and the second voltage source 802 can generate a DC voltage of about −200 V. The first voltage source 801 and the second voltage source 802 may generate a superimposed voltage of AC and DC. In addition, although FIG. 12 shows separate voltage sources 801 and 802, in some examples a single voltage source configured to generate two different voltages may be used. In FIG. 12 the lubricant application device 800 is disposed downstream of a static elimination device 12 along the rotational direction Ra of the photosensitive drum 40. Accordingly, the electric potential at a portion of the photosensitive drum 40 facing the grinding roller 101 can be about 0 V. In some examples, the electric potential V1 of the elastic body 101*b*, the electric potential V2 of the scattering member 504 and the electric potential V3 of the photosensitive drum 40 can be expressed as follows. That is, $$V1\ (e.g.,\ -400\ \mathrm{V}) < V2\ (e.g.,\ -200\ \mathrm{V}) < V3\ (e.g.,\ 0\ \mathrm{V})$$

Application of a DC voltage to the elastic body 101*b* of the grinding roller 101 can impart a charge to the fine particles of the lubricant that are carried on the elastic body 101*b*. Accordingly, the fine particles of the lubricant carried on the elastic body 101*b* that are pulverized and flicked out onto the photosensitive drum 40 by the scattering member 504, can simultaneously, be electrically moved (e.g., electrostatically transferred by electrostatic charges) onto the photosensitive drum 40 due to the electric potential difference between the elastic body 101*b* and the scattering member 504, and the electric potential difference between the scattering member 504 and the photosensitive drum 40, to further increase the amount of fine particles of the lubricant scattered toward the photosensitive drum 40.

It is to be understood that not all aspects, advantages and features described herein may necessarily be achieved by, or included in, any one particular example. Indeed, having described and illustrated various examples herein, it should be apparent that other examples may be modified in arrangement and detail is omitted.

The invention claimed is:

1. A lubricant application device for an image forming apparatus, the device comprising:

a grinding roller to carry, upon rotation, a lubricant scraped off from a solid lubricant source; and a scattering member disposed to contact the grinding roller at an outer periphery thereof to scatter the carried lubricant toward a separate rotating member, wherein the scattering member comprises a perforated member that is curved to substantially follow the outer periphery of the grinding roller.

2. The lubricant application device according to claim 1, wherein the rotating member comprises an image carrier.

3. The lubricant application device according to claim 1, wherein the grinding roller and the scattering member are spaced apart from the rotating member.

4. The lubricant application device according to claim 1, wherein the perforated member includes a flat plate.

5. The lubricant application device according to claim 1, wherein the perforated member includes one or more holes having a rectangular shape.

6. The lubricant application device according to claim 1, further comprising a blade located on a downstream side of the grinding roller in a direction in which a surface of the rotating member moves, the blade to abut the surface of the rotating member in order to apply an even layer of the lubricant scattered toward the rotating member.

7. The lubricant application device according to claim 1, wherein the grinding roller and the scattering member are conductive, and the lubricant application device comprises a voltage source to apply different voltages to the grinding roller and to the scattering member.

8. An image forming apparatus comprising:

a grinding roller that is rotatable to scrape off lubricant from a solid lubricant source; and a scattering member to engage the grinding roller, to disperse the lubricant from the grinding roller to a surrounding region of the grinding roller when the grinding roller rotates, wherein the scattering member comprises one or more wires.

9. The image forming apparatus according to claim 8, wherein the grinding roller includes a brush roller having a central axis and bristles that extend radially relative to the axis, to carry the lubricant having been scraped off.

10. A lubricant application device for an image forming apparatus, the device comprising:

a grinding roller to carry, upon rotation, a lubricant scraped off from a solid lubricant source; and a scattering member disposed to contact the grinding roller at an outer periphery thereof to scatter the carried lubricant toward a separate rotating member, wherein the scattering member includes one or more rod-shaped member having a cross-section having a round shape or a rectangular shape, and wherein the one or more rod-shaped member comprises a central axis and is rotatable about the central axis.

11. The lubricant application device according to claim 10, wherein the rotating member comprises an image carrier.

12. The lubricant application device according to claim 10, wherein the grinding roller and the scattering member are spaced apart from the rotating member.

13. The lubricant application device according to claim 10, further comprising a blade located on a downstream side of the grinding roller in a direction in which a surface of the rotating member moves, the blade to abut the surface of the rotating member to apply an even layer of the lubricant scattered toward the rotating member.

14. The lubricant application device according to claim 10, wherein the grinding roller is rotatable clockwise and counterclockwise.

15. The lubricant application device according to claim 10, wherein the grinding roller and the scattering member are conductive, and the lubricant application device comprises a voltage source to apply different voltages to the grinding roller and to the scattering member.

* * * * *